US005367321A

United States Patent [19]

Shigenori et al.

[11] Patent Number: 5,367,321

[45] Date of Patent: Nov. 22, 1994

[54] THERMAL LINE PRINTER WITH PLURAL THERMAL HEAD SUBSTRATES

[75] Inventors: Ota Shigenori; Kawata Akihiko, both of Aira, Japan

[73] Assignee: Kyocera Corporation, Kyoto, Japan

[21] Appl. No.: 766,818

[22] Filed: Sep. 26, 1991

[30] Foreign Application Priority Data

Sep. 29, 1990 [JP] Japan ..... 2-261964

[51] Int. Cl.[5] ..... B41J 2/335; B41J 2/345

[52] U.S. Cl. ..... 346/76 PH

[58] Field of Search ..... 346/76 PH

[56] References Cited

U.S. PATENT DOCUMENTS 5,229,788 7/1993 Shimada et al. ..... 346/76 PH

FOREIGN PATENT DOCUMENTS 55-9302 3/1980 Japan .
63-166428 10/1988 Japan .
0056561 3/1989 Japan ..... 346/76 PH
272967 3/1990 Japan .

*Primary Examiner*—Benjamin R. Fuller
*Assistant Examiner*—Huan Tran
*Attorney, Agent, or Firm*—Spensley Horn Jubas & Lubitz

[57] ABSTRACT

When composing a long thermal head by joining plural insulating substrates forming linear heating resistance element rows in the arranging direction, if the distance of the heating resistance elements at the remotest position of the insulating substrates is extended, a white stripe (white out) is formed at a position corresponding to the junction of the insulating substrates at the time of printing. In the invention, in the heating resistance element rows on the mutually adjacent insulating substrates, the heating resistance elements at the remotest position on each substrate are mutually jointed in a state of being deviated by 0.2 to 1.5 mm in the subscanning direction. Therefore, the height of the composition on the adjacent insulating substrate on an extended line of the heating resistance element rows on one insulating substrate is lower than the height of the heating resistance element rows on the same one insulating substrate. Hence, faulty contact of the heating resistance element at the remotest position with the platen roller or the like is prevented, and the quality of thermal printing may be outstandingly enhanced.

25 Claims, 13 Drawing Sheets

Prior Art
Fig. 2
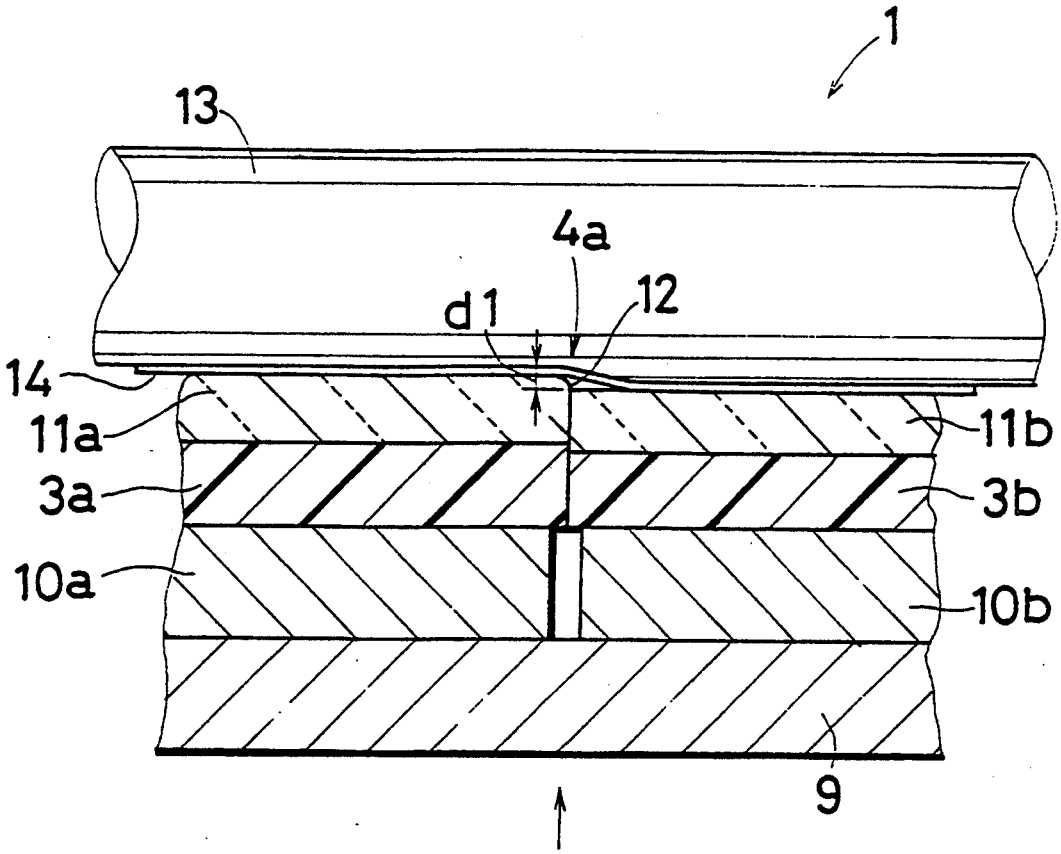
Prior Art Fig. 4
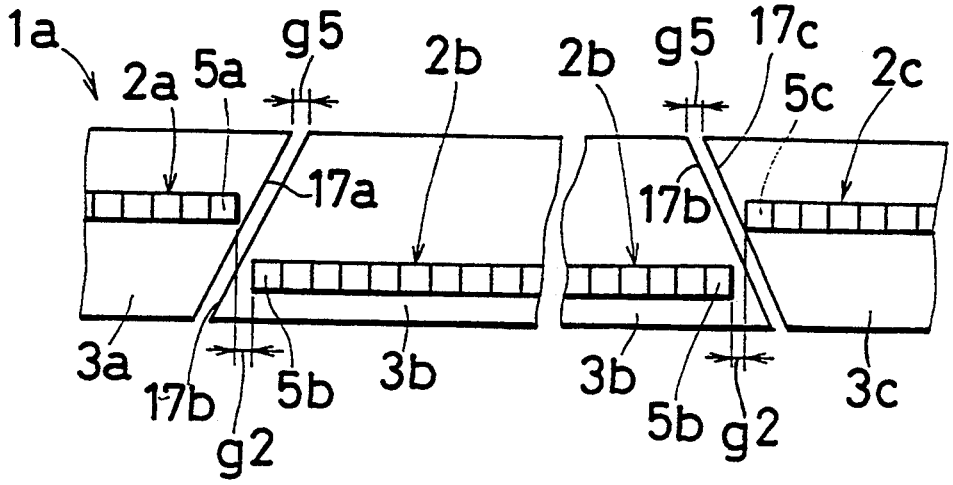

Prior Art Fig. 5
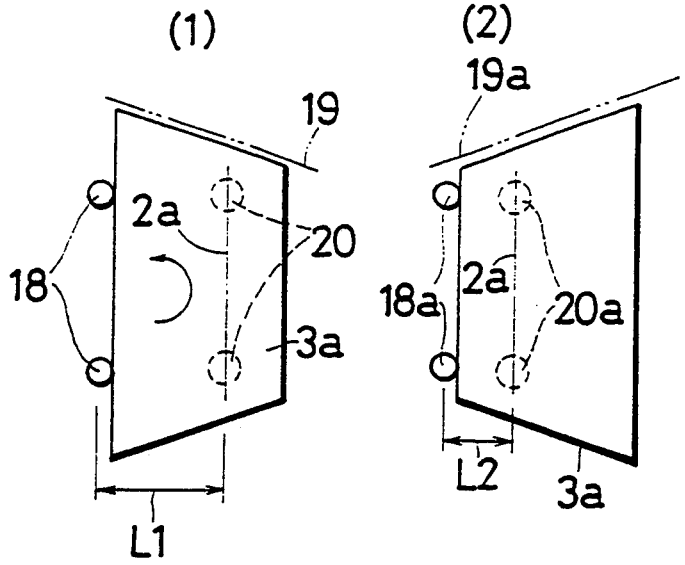
Prior Art Fig. 6
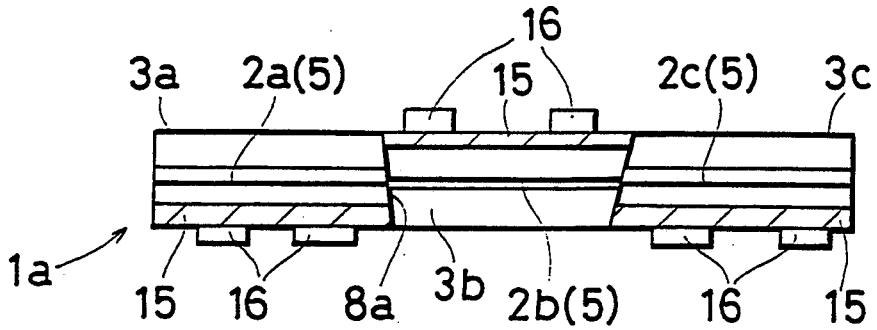
Prior Art Fig. 7
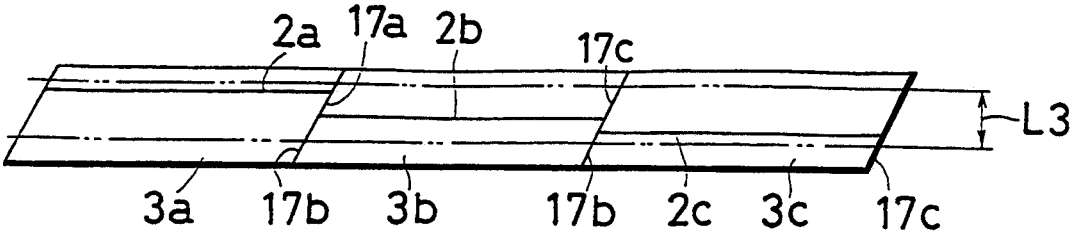

THERMAL LINE PRINTER WITH PLURAL THERMAL HEAD SUBSTRATES

BACKGROUND OF THE INVENTION

1. Field of the Invention

The present invention relates to a long thermal head composed by combining plural electric insulating substrates.

2. Description of the Prior Art

As the thermal head for use in thermal printing, the function of thermally recording as line printer in recording paper of JIS A1 or A0 format is required. It is at the present technically difficult to compose such long thermal head from a single head substrate made of ceramics such as electric insulating material, and it is therefore attempted to compose a long thermal head by mutually joining a plurality of head substrates.

FIG. 1 is a plan view of a typical conventional long thermal head 1. The thermal head 1 is composed of, for example, three head substrates 3*a*, 3*b*, 3*c* having heating resistance element rows 2*a*, 2*b*, 2*c* (collectively indicated by reference number 2) formed on the principal plane thereof respectively, which are mutually joined at junction positions 4*a*, 4*b* along the arranging direction of the heating resistance element row 2, so that the individual heating resistance element rows 2*a*, 2*b*, 2*c* may form a straight line.

FIG. 2 is a sectional view of the thermal head 1, and FIG. 3 is a magnified plane view near the junction position 4*a*, for example, of the thermal head 1. In the thermal head 1, cooling plates 10*a*, 10*b* of metal material are mounted on a support plate 9 made of metal material, and the head substrates 3*a*, 3*b* are mounted on the cooling plates 10*a*, 10*b*. On the head substrates 3*a*, 3*b*, glazed layers 11*a*, 11*b* made of, for example, glass are formed, and a heating resistance element layer (not shown) and common electrode 6 and individual electrode 7 are formed thereon, thereby forming a heating resistance element 5, so that thermal recording is effected on a thermal recording paper 14 against a platen roller 13.

On the head substrates 3*a*, 3*b*, at a mutual gap g1, plural heating resistance elements 5 are linearly formed respectively. At one common side of the heating resistance element rows 2*a*, 2*b*, at the head substrates 3*a*, 3*b*, the common electrode 6 commonly connected to the heating resistance element is formed, and on the opposite side of the common electrode 6 across the heating resistance elements 5, individual electrodes 7 individually connected to the respective heating resistance elements 5 are formed.

In such long thermal head 1, when the gap g2 of the heating resistance elements 5*a*, 5*b* at the remotest position along the arranging direction on the head substrates 3*a*, 3*b*, 3*c* becomes about $\frac{1}{3}$, for example, of the arranging pitch g3 of the heating resistance elements 5, an unprinted at the time of thermal printing occurs at the junction position 4*a* (white-out). Accordingly, in order to shorten the gap g2 of the heating resistance elements 5*a*, 5*b* at the remotest position as far as possible, in this prior art, the shape of the common electrodes 6 on the head substrates 3*a*, 3*b* is warped so that the heating resistance elements 5*a*, 5*b* at the remotest position may approach toward the end portions 8*a*, 8*b* mutually joined to the head substrates 3*a*, 3*b*. The same holds true with the individual electrodes 7. In this way, it is attempted to prevent formation of white stripe in thermal printing between the heating resistance elements 5*a*, 5*b* at the remotest position.

In this prior art, although the white stripe in thermal printing is prevented by approaching the heating resistance elements 5*a*, 5*b* at the remotest position, a step difference 12 of height d1 may be formed between the glazed layers 11*a*, 11*b* at the junction position 4*a* due to fluctuations of the machining precision and manufacturing thickness or other dimensional precision of the glazed layers 11*a*, 11*b*, head substrates 3*a*, 3*b* and cooling plates 10*a*, 10*b* on the head substrates 3*a*, 3*b*.

As shown in FIG. 3, when the distance g4 between the heating resistance element 5*a* at the remotest position of the head substrate 3*a* and the end portion 8*a* is 5 to 10 μm and the gap relation is g1 g2 15 to 20 μm, if the height d1 of the step difference 12 is 3 to 5 μm, a white stripe of 50 to 70 μm in width is formed, and if the height d1 is 20 μm, a white stripe of 70 to 120 μm in width was confirmed. Such white stripe significantly lowers the printing quality.

By placing a metal foil or other spacer between the cooling plates 10*a*, 10*b* and the support plate 9, the height d1 of the step difference 12 may be controlled to about 3 to 5 μm, but it was known that a white stripe of 50 to 70 μm in width was formed at g2 of 20 μm if d1 was 5 μm. Due to such step difference 12, moreover, the heating resistance elements 5 including the heating resistance elements 5*a*, 5*b* at the remotest position and their vicinity may be pushed to the head substrates 3*a*, 3*b* by the platen roller 13, and may fail to contact with the thermal recording paper 14. When power is supplied to such heating resistance elements 5 not contacting with the thermal recording paper 14, the temperature of the heating resistance elements 5 is excessively raised, and the preset resistance of the heating resistance elements 5 may fluctuate, or the resistance elements may be broken, thereby shortening the service life of the thermal head 1.

Besides, as a second prior art intended to solve the problem of formation of white stripe in thermal printing by bringing the heating resistance element at the remotest position at the junction closer in the heating element resistance arranging direction, a thermal head 1*a* shown in FIG. 4 is known. This thermal head 1*a*, same as in the foregoing prior art, is composed by mutually joining, for example, three head substrates 3*a* to 3*c* to compose a long thermal head 1*a*. End portions 17*a*, 17*b*, 17*c* of the head substrates 3*a*, 3*c* are formed as being inclined obliquely to the heating resistance element rows 2*a* to 2*c*, and the head substrates 3*a* to 3*c* are formed in a trapezoidal profile in a plan view. The heating resistance element rows 2*a* to 2*c* of the head substrates 3*a* to 3*c* are composed across a gap y along the subscanning direction. At this time, moreover, the end portions 17*a* to 17*b* are composed across a gap g5.

In such second prior art, by shortening the distance g2 of the heating resistance elements 5*a* to 5*c* at the remotest position, it is intended to prevent formation of white stripe in thermal printing at the junction positions 4*a*, 4*b*.

However, in such second prior art, too, as explained by reference to FIG. 1, the step difference 12 at the junction positions 4*a*, 4*b* cannot be avoided, and the same white stripe is formed to lower the printing quality.

Still more, in this prior art, the head substrates 3*a* to 3*c* are formed in a trapezoidal profile in a plan view. For example, when obliquely cutting the both end of the head substrate 3*a*, as shown in FIG. 5 (1), it requires a first positioning member 18 for supporting one end in the widthwise direction of the head substrate 3*a* , a cutting member 19 for cutting or dicing, opposite to the head substrate 3, forming a specific angle in the arranging direction of the heating resistance element row 2*a*, and a second positioning member 20, with a gap L1 spaced from the first positioning member 18, for positioning when cutting obliquely with the cutting member 19.

On the other hand, when cutting the other end of the head substrate 3*a*, the head substrate 3*a* is rotated a half revolution as indicated by arrow in FIG. 8, and it also requires first and second positioning members 18*a*, 20*a* disposed at a narrower gap L2 than the gap L1 between the above first and second positioning members 18, 20, and a cutting member 19*a* opposite the head substrate 3*a* at a different angle from the cutting member 19. Thus, the composition for cutting becomes complicated.

FIG. 6 is a plan view explaining other problem of the conventional thermal head 1*a*. The thermal head 1*a* is formed in an extended length, same as in the first prior art, by mutually joining, for example, three head substrates 3*a* to 3*c*, and the head substrate 3*a* has an external wiring substrate 15 possessing a connector 16 for exchanging signals for thermal printing with an external device, connected at one side of the heating resistance element 5*a*. That is, the individual electrodes 7 in the foregoing prior art are formed from the heating resistance element rows 2*a* toward the external wiring substrate 15. The end portion 8*a* of the head substrate 3*a* is processed in a shape to obliquely intersect with the arranging direction of the heating resistance element row 2*a*.

In the head substrate 3*b* joined to the head substrate 3*a*, concerning the heating resistance element rows 2*b*, the external wiring substrate 15 is connected on the opposite side of the connecting direction of the external wiring substrate 15 of the head substrate 3*a*. In the head substrate 3*a* joined to the head substrate 3*b*, the external wiring substrate 15 is connected in the opposite direction of the connecting direction of the external wiring substrate 15 in the head substrate 3*b*.

In this prior art, since the external wiring substrate 15 and connector 16 are connected mutually in reverse directions in every head substrate 3, and the width in the vertical direction of the thermal head 1*a* in FIG. 5 is extended and the structure becomes larger, and still more when the thermal head 1*a* is formed as a thermal printer, it is necessary to wire connecting leads at both sides in this widthwise direction of the thermal head 1*a*, and the wiring is complicated, and moreover the structure for leading the recording paper 14 into the thermal head 1*a* and the structure of discharging from the thermal head 1*a* are complicated.

As a different prior art intended to solve the problems due to the trapezoidal forming of the head substrates 3*a* to 3*c*, as shown in FIG. 6, it may be considered to cut off the end portions 17*a* to 17*b* of the head substrate 3*a* by inclining in the same direction, but in this case, the heating resistance element rows 2*a* to 2*c* are sequentially deviated in the widthwise direction in every one of the head substrate 3*a* to 3*c*, and it is necessary to set the contact width L3 with the platen roller commonly including the heating resistance element rows 2*a* to 2*c* relatively larger. That is, the size of the platen roller 13 is increased.

SUMMARY OF THE INVENTION

It is hence a primary object of the invention to present a thermal head reduced in structure and enhanced reliability, while the printing quality is improved, by solving the technical problems discussed above.

To achieve the above object, the invention presents a thermal head composed by arranging a plurality of heating members. Each of the heating members includes an angle-shaped heat reserve layer extending in the longitudinal direction on a long-spanning insulating substrate, with heating resistance element rows linearly disposed on the top of the heat reserve layer, mutually in such a configuration in which the linear heating element resistance element rows are deviated by 0.2 to 1.5 mm in the subscanning direction.

The thermal head of the invention is composed by arranging a plurality of heating members, provided with an angle-shaped heat reserve layer extending in the longitudinal direction on a long-spanning insulating substrate, and heating resistance element rows disposed on the top of the heat reserve layer, in a configuration of deviating the heating resistance element rows by 0.2 to 1.5 mm in the subscanning direction.

Accordingly, in the heating resistance element rows mutually adjacent on the insulating substrate, if there is a step difference in the height from each insulating substrate of the heating resistance element at the remotest position, the heating resistance element at the remotest position on each substrate abuts against with, for example, the platen roller in a state of being deviated by 0.2 to 1.5 mm in the subscanning direction. Furthermore, the heating resistance element rows are formed linearly, with the section near the top of the angle-shaped heat reserve layer, and the heating resistance element rows are spaced by a predetermined distance in the subscanning direction, and the height of the composition on the insulating substrate adjacent on the extended line of the heating resistance element rows on one insulating substrate is lower than the height of the heating resistance element rows on the one insulating substrate.

Therefore, if there is a step difference in the adjacent insulating substrates, faulty contact of the heating resistance element at the remotes position with the platen roller may be prevented, and the thermal printing quality may be outstandingly improved. In the event of the step difference of height, faulty contact of the heating resistance element with the platen roller is avoided, and variation of resistance, breakage or other troubles due to excessive elevation of the temperature of the heating resistance clement may be prevented, so that the reliability may be enhanced.

Besides, near the junction end of the heating resistance element rows, the contact with the thermal recording paper or platen roller is strong, and depression stripe (black stripe) in printing or breakage of protective film outermost part may be prevented by chamfering.

The individual electrodes on each insulating substrate are formed toward one common side from the heating resistance element rows, and therefore the external wiring substrates connected to these individual electrodes may be disposed only on that common side. As a result, as compared with the composition of the external wiring substrates disposed mutually on opposite sides in every adjacent substrate, the thermal head may be reduced in size.

Thus, according to the invention, the thermal head is composed by arranging a plurality of heating members, provided with an angle-shaped heat reserve layer extending in the longitudinal direction on a long-spanning insulating substrate, and heating resistance element rows disposed on the top of the heat reserve layer, in a configuration of deviating the heating resistance element rows by 0.2 to 1.5 mm in the subscanning direction. At this time, the gap of the remotest position of the insulating substrate along the arranging direction of the heating resistance elements is nearly equal to the gap of arrangement of the heating resistance elements in the joined state.

Therefore, in the heating resistance element rows on the mutually adjacent insulating substrates, if there is a step difference in the height from the insulating substrate of the heating resistance element at the remotest position, the heating resistance element at the remotest position on each substrate about against, for example, the platen roller in a state of being deviated by 0.2 to 1.5 mm in the subscanning direction. Furthermore, the heating resistance element rows are formed linearly with the section near the top of the angle-shaped heat reserve layer, and such heating resistance element rows are spaced by a predetermined distance in the subscanning direction, and the height of the composition on the adjacent insulating substrate on the extended line of the heating resistance element rows on adjacent insulating substrate is lower than the height of the heating resistance element row on adjacent insulating substrate.

Therefore, if there is a step difference among adjacent insulating substrates, faulty contact of the heating resistance element at the remotest position with the platen roller may be prevented, and the thermal printing quality may be notably improved. Besides, in the event of the step difference of the height, faulty contact of the heating resistance element with platen roller may be prevented, and variation of resistance or breakage or other trouble due to excessive elevation of temperature of the heating resistance elements may be prevented, and the reliability may be enhanced.

Besides, near the junction end of the heating resistance element rows, the contact with the thermal recording paper or platen roller is strong, and depression stripe (black stripe) in printing or breakage of protective film outermost part may be prevented by chamfering. The individual electrodes on each insulating substrate are formed toward one common side from the heating resistance element rows, and therefore the external wiring substrates connected to these individual electrodes may be disposed only on that common side. As a result, as compared with the composition of the external wiring substrates disposed mutually on opposite sides in every adjacent substrate, the thermal head may be reduced in size.

BRIEF DESCRIPTION OF THE DRAWINGS

Other and further objects, features, and advantages of the invention will be more explicit from the following detailed description taken with reference to the drawings wherein:

FIG. 2 is a sectional view of the thermal head 1;

FIG. 4 is a plan view of a second prior art;

FIG. 5 is a plan view explaining polishing process in a prior art;

FIG. 6 is a plan view of a third prior art;

Figure 1:
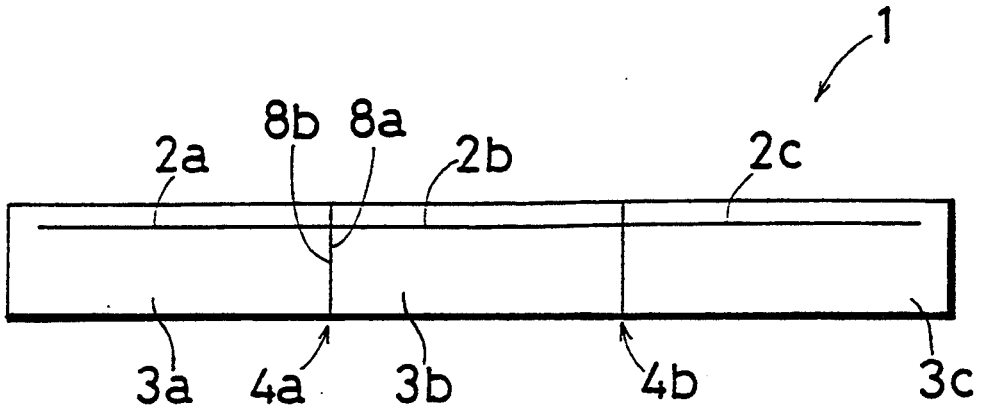
Prior Art Fig. 1
FIG. 1 is a plan view of a conventional thermal head 1.
Figure 3:
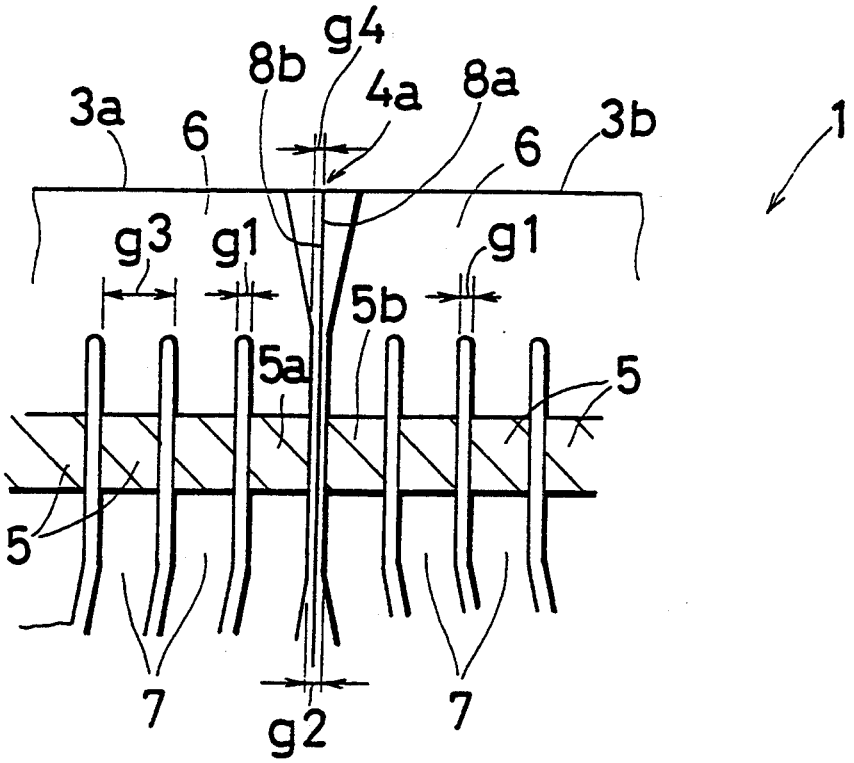
Prior Art Fig. 3
FIG. 3 is a magnified plant view near a heating resistance element 5.
Figure 8:
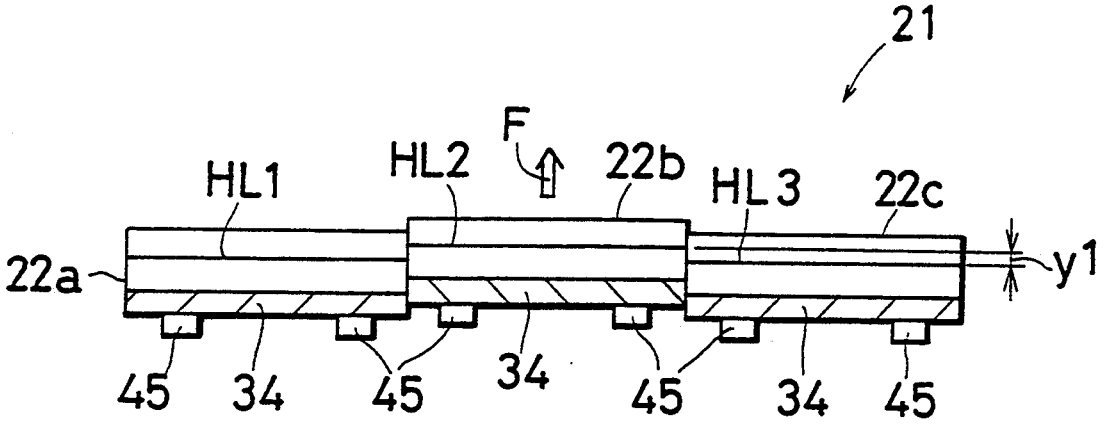
Figure 9:
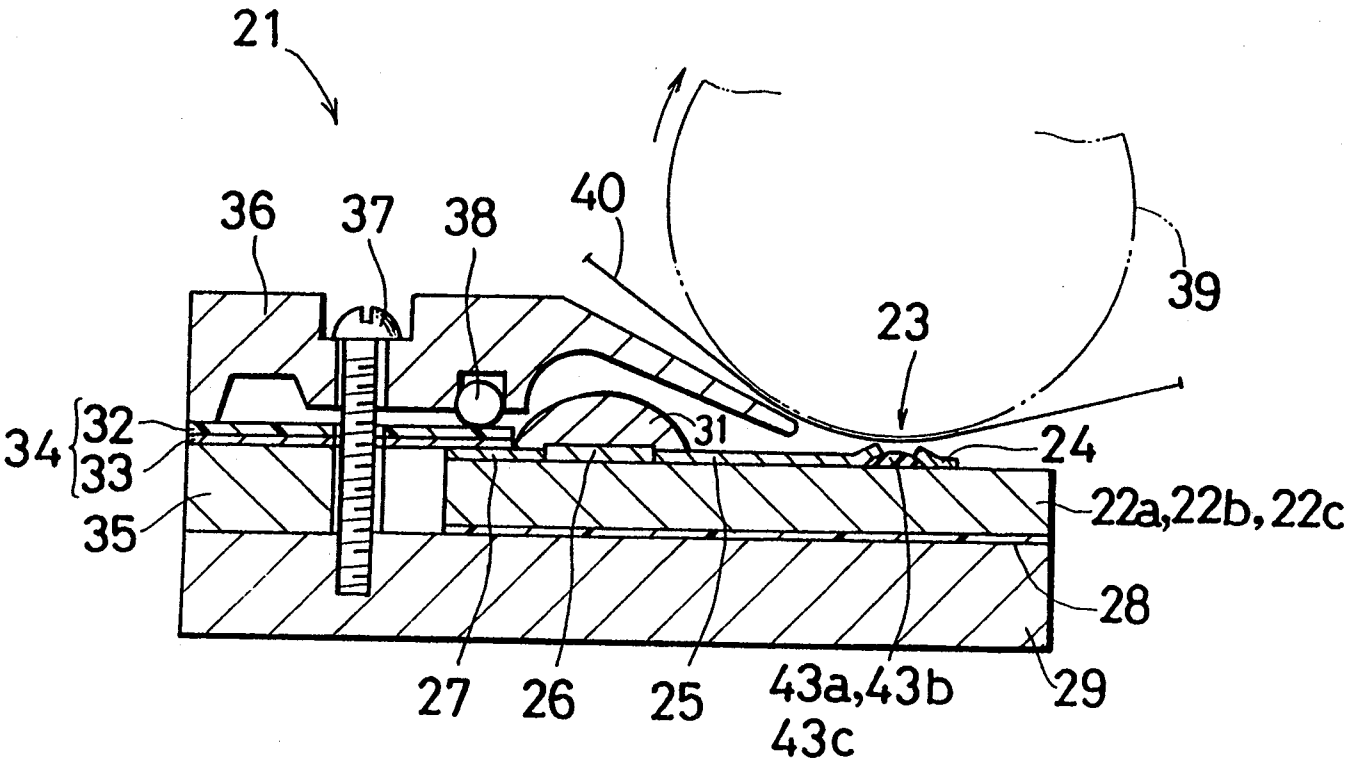
Figure 10:
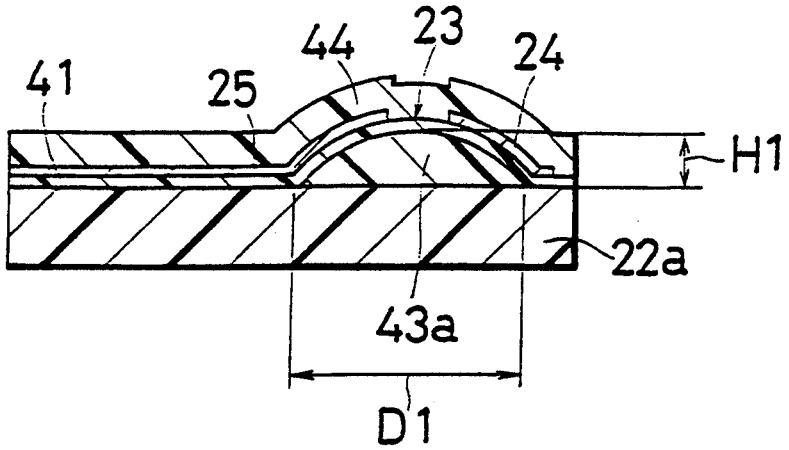
Figure 11:
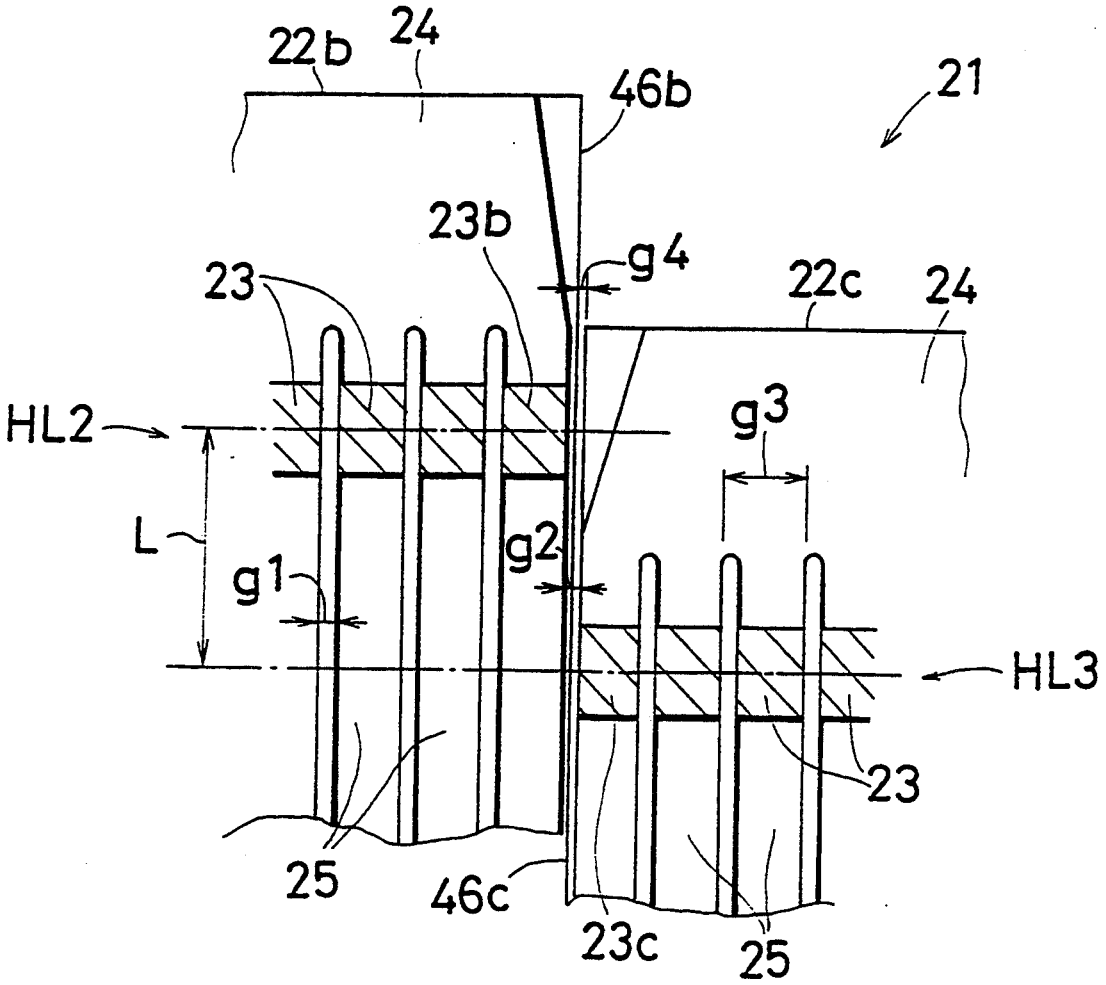
Figure 12:
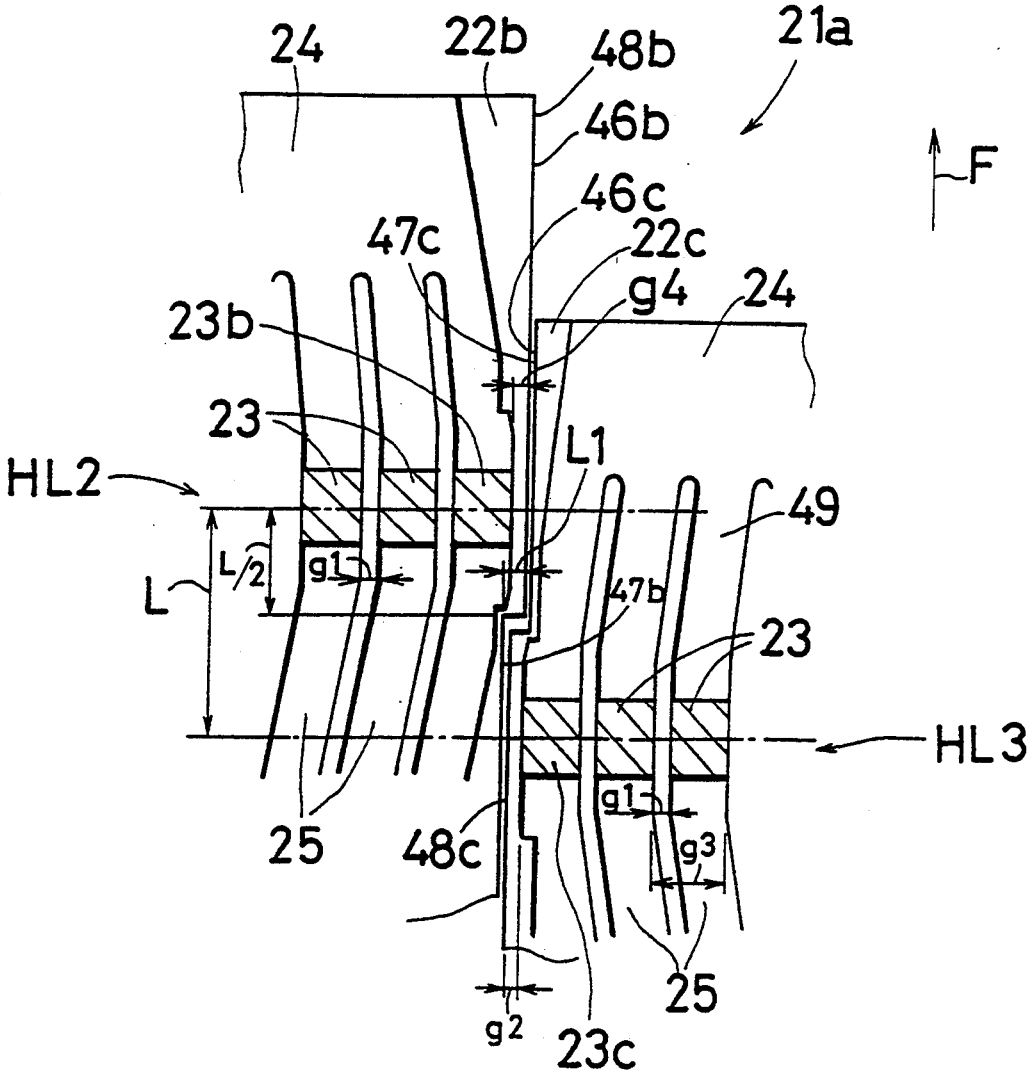
Figure 13:
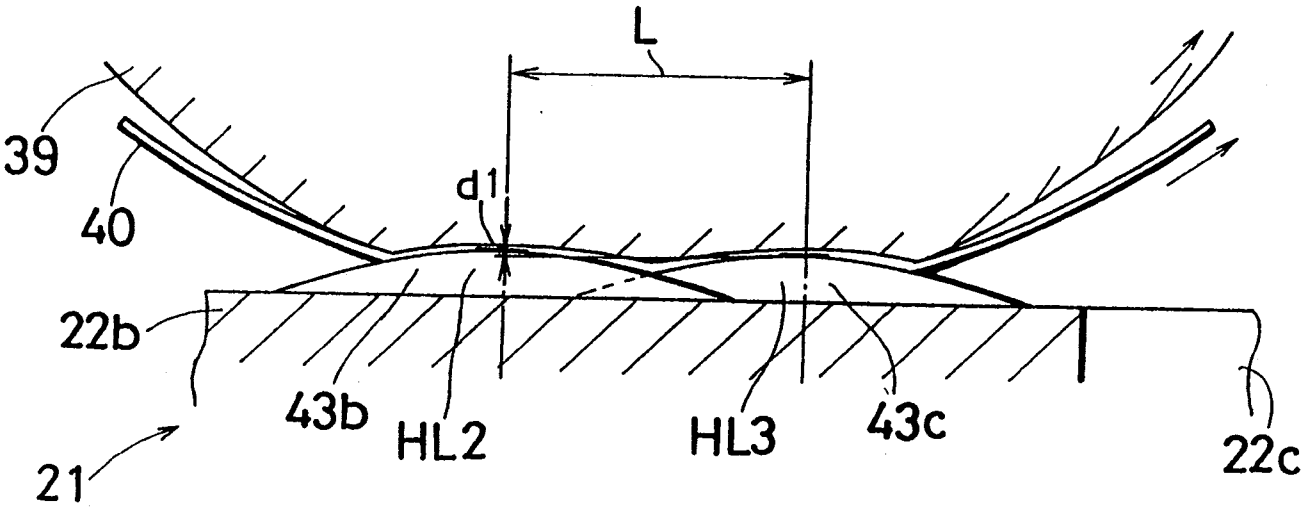
Figure 14:
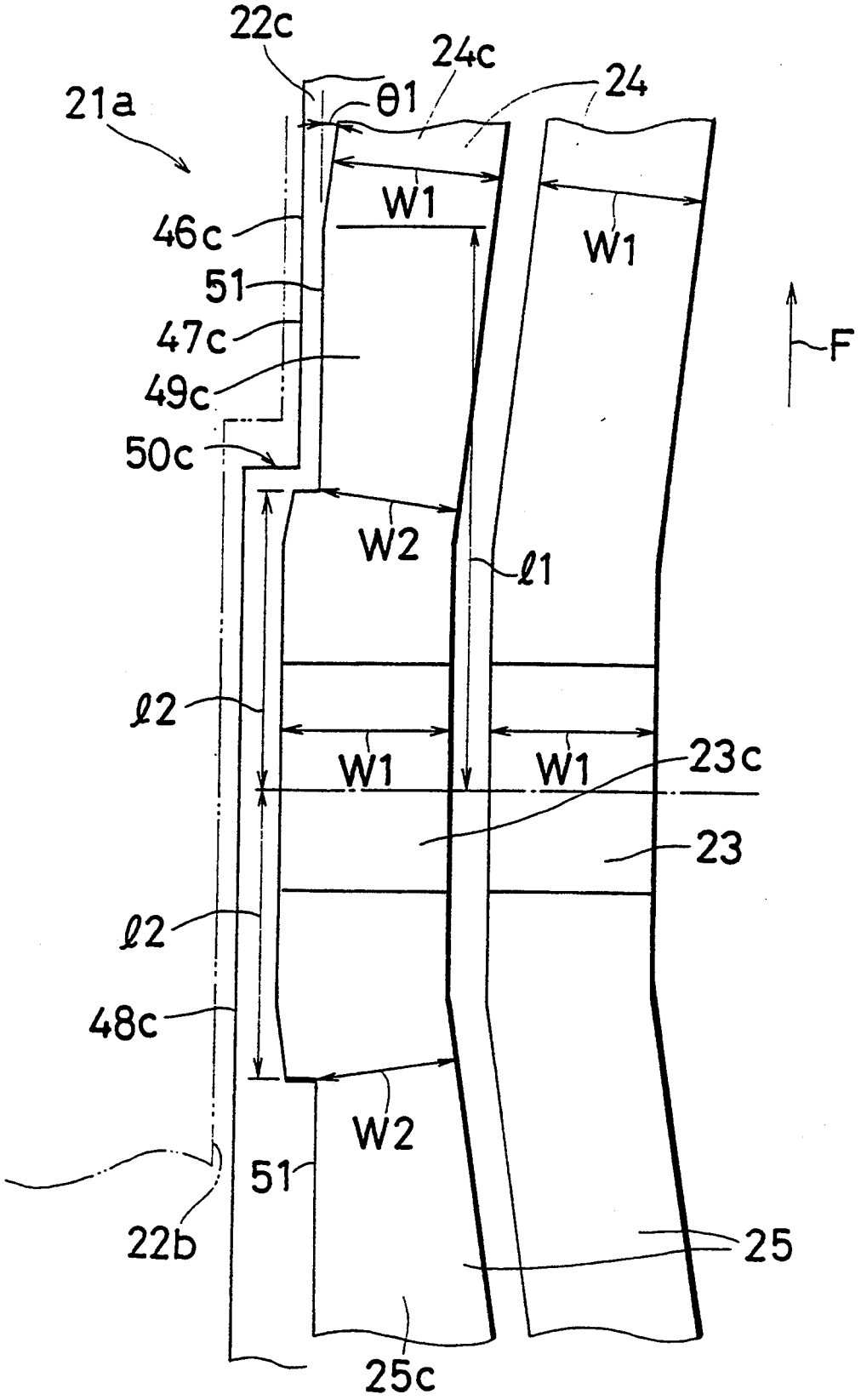
Figure 15:
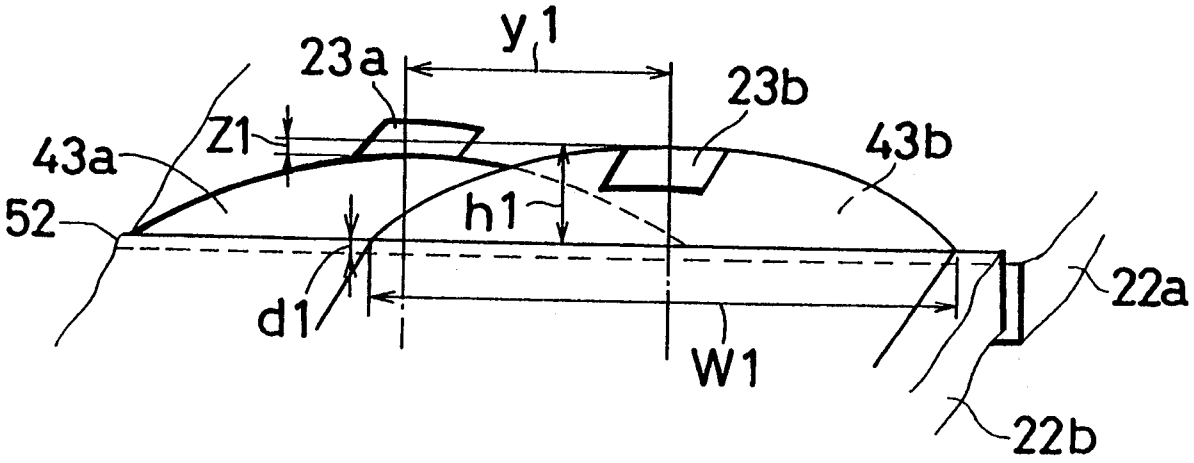
Figure 16:
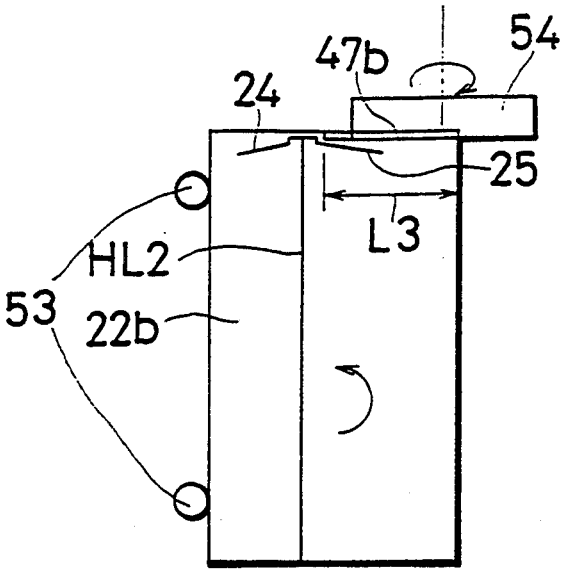
Figure 17:
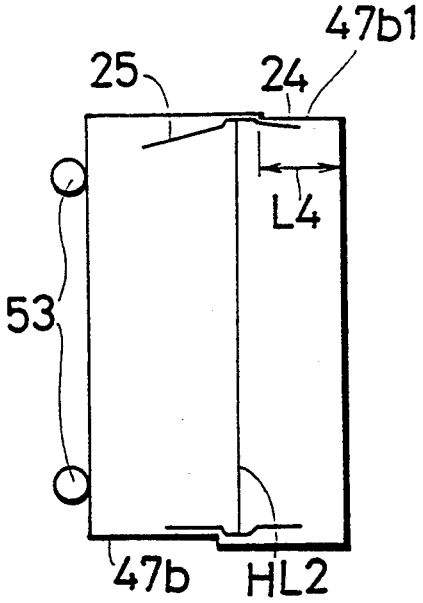
Figure 18:
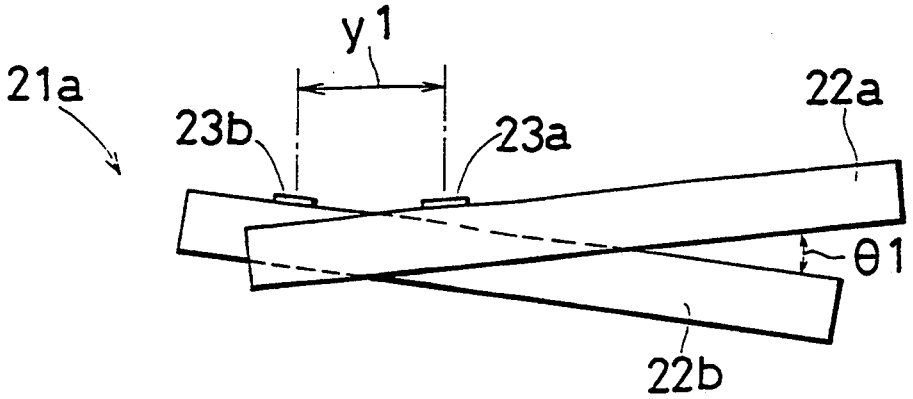
Figure 19:
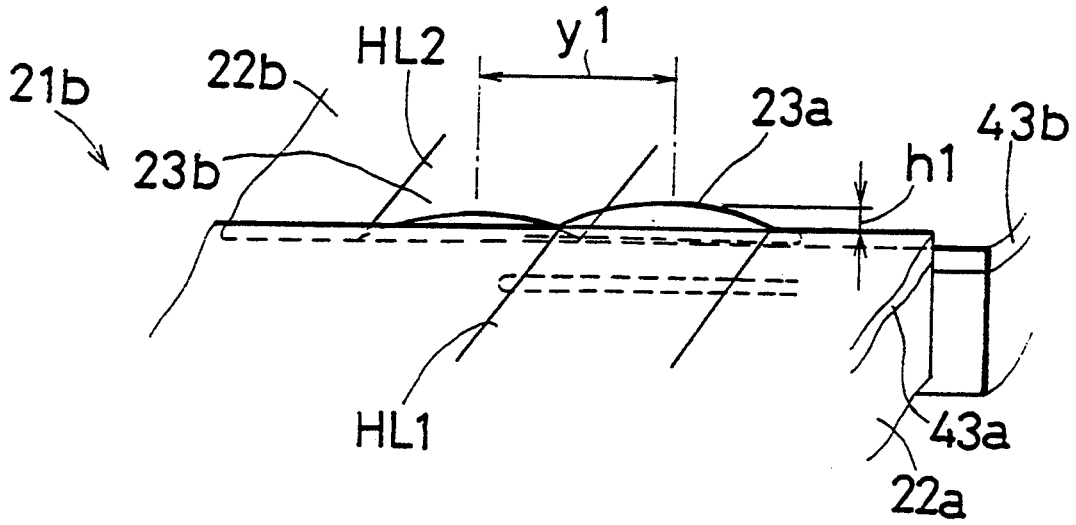

7 is a plan view showing a different prior art;

FIG. 8 is a plan view of a thermal head 21 of an embodiment of the invention;

FIG. 9 is a sectional view of the thermal head 21;

FIG. 10 is a magnified sectional view near a heating resistance element 23;

FIG. 11, FIG. 12 are magnified plan views of head substrates **22*b*, 22*c***;

FIG. 13 is a magnified sectional view near glazed layers **43*b*, 43*c***;

FIG. 14 is a magnified plan view near an end portion **46*b***;

FIG. 15 is a magnified prospective view near heating resistance elements **23*a*, 23*b*** at the remotest position;

FIG. 16, FIG. 17 are plan views for explaining the polishing process of this embodiment;

FIG. 18 is a perspective view showing the composition of a thermal head **21*a* in other embodiment of the invention; and FIG. 19 is a magnified view of a thermal head 21*b*** in a different embodiment of the invention.

DETAILED DESCRIPTION OF THE PREFERRED EMBODIMENTS

Now referring to the drawing, preferred embodiments of the invention are described below.

FIG. 8 is a plan view of a thermal head 21 in an embodiment of the invention, FIG. 9 is a sectional view of the thermal head 21, and FIG. 10 is a magnified sectional view of a head substrate **22*a*. The thermal head 21 comprises, for example, three head substrates 22*a*, 22*b*, 22*c* (collectively indicated by reference number 22) formed in a rectangular plate shape from an electrically insulating material such as aluminum oxide $Al_2O_3$. On the head substrates 22*a*, 22*b*, 22*c* are respectively formed glazed layers 43*a*, 43*b*, 43*c* being made of glass, with the width D1 in the subscanning direction (for example, 1.275 mm) and height H1 (for example, 50 μm), having an angle-shaped section such as semi-arc form, and extending linearly almost in the overall length of the head substrates 22*a*, 22*b*, 22*c*** in the principal scanning direction.

On the glazed layer 43 is formed a resistance element layer 41 almost over the entire surface of each substrate 22, being made of, for example, tantalum nitride $Ta_2N$, nichrome Ni—Cr, or ruthenium oxide $RuO_2$, by thin film technique such as evaporation or sputtering, or thick film technique such as screen printing, or etching technique. On the resistance element layer 41, common electrode 24, individual electrode 25, and signal line 27 made of metal such as aluminum Al and gold Au are formed by thin film technique or thick film technique. The resistance element layer 41 defined by the common electrodes 24 and individual electrodes 25 composes a linearly formed heating resistance element 23, thereby making up heating resistance element rows HL1, HL2, HL3.

The heating resistance element 23 applies thermal printing on thermal recording paper, thermal film and recording paper, and is heated to about 400° C. when the power is supplied. The heating resistance element 23 is connected parallel to the common electrode 24 in every one of the head substrates **22*a*, 22*b*, 22*c*, and the individual electrode is connected on the opposite side of the common electrode 24** of the heating resistance element 23. To cover the common electrode 24, heating resistance element 23 and individual electrode 25, a wear resistant layer 44 made of, for example, silicon nitrode $Si_3N_4$ is formed.

The individual electrodes 25 are connected to driving circuit elements 26, by a predetermined number each, and plural signal lines 27 are connected to the driving circuit elements 26 for feeding image data or control signals for printing by the heating resistance elements 23.

The head substrates 22*a*, 22*b*, 22*c* are mounted on cooling plates 29*a*, 29*b*, 29*c*, in a configuration as described below, made of aluminum or other metallic material in a rectangular plate shape, with soft adhesive 28. The thermal head 21 is covered with a protective layer 31 in the area of the plural driving circuit elements 26 disposed on the head substrates 22*a*, 22*b*, 22*c*. Near the opposite end of the driving circuit elements 26 of the signal lines 27, a circuit wiring 33 is formed on a flexible film 32, and it is connected to a flexible wiring substrate 34 having a connector 45 for exchanging data with an external device. The flexible wiring substrate 34 is disposed on a spacer 35 set on the cooling plates 29*a*, 29*b*, 29*c*.

A head cover 36 is disposed to cover a range from the individual electrodes 25 to the flexible wiring substrate 34, and this head cover 36 is fixed with screws 37 on the cooling plates 29*a*, 29*b*, 29*c*. This head cover 36 contains an elastic piece 38 for pressing the flexible wiring substrate 34 to the signal lines 27 on the head substrates 22*a*, 22*b*.

Such thermal head 21 is disposed close to a platen roller 39, and the heating resistance element 23 presses the thermal recording paper 40 on the platen roller 39 against the platen roller 39, while the heating resistance element 23 are selectively energized or de-energized with electric power, thereby printing as desired.

In the thermal head 21 of the embodiment, as shown in FIG. 8, the head substrates 22*a* to 22*c* are disposed in a state being deviated mutually by length y1 along the subscanning direction F. The flexible wiring substrate 34 and connector 45 on the head substrates 22*a* to 22*c* are disposed at one common side (the lower side in FIG. 8), with respect to the heating resistance element rows HL1 to HL3.

In the embodiment, the heating resistance element rows HL2, HL3 are formed near the ridge on the semi-arc shaped heat reserve layer 43*a* as shown in FIG. 10, and the distance L of the spacing of the heating resistance element rows is set as specified so that the composition on the electrically insulating head substrate 22*c* adjacent on the extended line of, for example, the heating resistance element row HL2 may be lower than the heating resistance element 23 near the junction, so that formation of white stripe (white out) at the time of thermal printing may be prevented, thereby enhancing the printing quality.

FIG. 11 shows an example of magnified plan view near the end portions 46*b*, 46*c*mutually opposing the head substrates 22*b*, 22*c*. In this embodiment, in the head substrates 22*b*, 22*c*, the heating resistance elements 23 in the heating resistance element rows HL2, HL3 are formed linearly at a gap of g1 (for example, about 25 μm) and a pitch of g3 (for example, 125 μm). Moreover, the heating resistance elements 23*b*, 23*c* at the remotest position mutually opposing the head substrates 22*b*, 22*c*, and the end portions 46*b*, 46*c* of the head substrates 22*b*, 22*c* are selected at a distance of g4 (for example, 5 to 10 μm). In this embodiment, in order to shorten the distance g4 as much as possible, in both head substrates 22*b* and 22*c*, the shape near the end of the end potions 46*b*, 46*c* of the common electrodes 24 is formed in a shape of inclining to the side of the end portions 46*b*, 46*c*, as becoming closer to the heat resistance elements 23.

In the embodiment, the heating resistance element rows HL1, HL2 of the head substrates 22*b*, 22*c* are defined to be spaced by a predetermined distance L (for example, 0.2 mm or more) along the subscanning direction F. That is, the length y1 is set at 0.2 mm or more.

FIG. 12 is an example of a magnified plan view near the end portions 46*b*, 46*c* mutually opposing the head substrates 22*b*, 22*c*. In this embodiment, in the head substrates 22*b*, 22*c*, the heating resistance elements 23 in the heating resistance element rows HL2, HL3 are formed linearly at a gap of g1 (for example, about 15 μm) and a pitch of g3 (for example, 125 μm). Moreover, the heating resistance elements 23*b*, 23*c* at the remotes position mutually opposing the head substrates 22*b*, 22*c*, and the end portions 46*b*, 46*c* of the head substrates 22*b*, 22*c* are selected at a distance of g4 (for example, 5 to 10 μm).

In this embodiment, in the plural head substrates 22*b*, 22*c* as shown in FIG. 12, located downstream side in the conveying direction F of the recording paper than the adjacent head substrate, for example at the end portion 46*b* at both ends of the principal scanning direction of the head substrates 22*b*, a recess 47*b* of a depth L1 is formed along the principal scanning direction, toward the upstream side further from the position of about distance L/2 remote to the upstream side of the conveying direction F from the heating resistance element row HL2, inward of the head substrate 22*b*.

With such shape of the end portion 46*b* of the head substrate 22*b*, the common electrodes 24 are bent toward the end portion 46*b* as in the foregoing embodiment, and the individual electrodes 25 near the end portion 46*b* are bent so as to incline to the side of the end portion 46*b* as going along the heating resistance element 23.

In the embodiment, the heating resistance element rows HL2, HL3 of the head substrates 22*b*, 22*c* are determined to be spaced by a predetermined distance L (for example, 0.2 mm or more) along the subscanning direction F. That is, the length y1 is set at 0.2 mm or more. If less than 0.2 mm, it was confirmed that white stripe was formed.

FIG. 13 is a sectional view of the thermal head 21 for explaining the operation of the embodiment. On the head substrates 22*b*, 22*c*, glazed layers 43*b*, 43*c* are formed, and heating resistance element rows HL2, HL3 are disposed near their peak, at a spacing of distance L. In the embodiment, the relative position of the head substrates 22*b*, 22*c* is adjusted so that the head substrates 22*b*, 22*c* may be parallel to the principal scanning direction. As a result, the gap g2 along the principal scanning direction of the heating resistance elements 23*b*, 23*c* at the remotest position in FIG. 11 may be easily matched with the gap g1 of arrangement of the heating resistance elements 23. That is, in the thermal head 21, formation of white stripe (white out) experienced in the conventional thermal printing is prevented, and the printing quality is improved.

The distance L in the subscanning direction in the embodiment is determined as follows. When the density in the principal scanning direction of the heating resistance elements 23 is 8 dots/ram, the printing dot density in the subscanning direction is 8 dots/mm, and the printing dot pitch is 125 μm. For example, the distance L is selected at 125 μm×4=500 μm, on the basis of the printing dot pitch of 127 μm in the subscanning direction.

When the diameter of the platen roller 39 used in printing at this time is, for example, 38 mm, and the rubber hardness of the platen roller is 40 to 50 degrees, the pressing force of the platen roller 39 on the head substrates 22b, 22c is set at 0.15 kg/cm. If, at this time, the heating resistance element rows HL1, HL2 are different by the height d1 about the maximum of 20 μm of the tolerance, for example, concerning the height from the head substrates 22b, 22c, as far as the subscanning direction distance L is 0.2 mm or more, the heating resistance element rows HL2, HL3 contact with the platen roller 39 favorably without being influenced by such step difference, so that an excellent printing may be made on the recording paper 40.

It thus prevents faulty contact of the heating resistance elements 23 with the platen roller 39 or recording paper 40, or unexpected change of resistance or breakage of the heating resistance elements 23, so that the reliability may be enhanced.

FIG. 14 is a magnified plan view near the end portion 46c of the head substrate 22c. To form a protrusion 48c and a recess 47c at the end portion 46c of the head substrate 22c, the shape of the branching part 49 of the common electrode 24 near the end portion 46c and the individual electrodes 25 must be warped to the side of the end portion 46c more as coming closer to the heating resistance elements 23. In this embodiment, therefore, as approaching the both ends in the principal scanning direction of the head substrate 22c, the common electrodes 24 and individual electrodes 25 are warped as stated above. The branching part 49c of the common electrode 24c and the individual electrode 25c closest to the end portion 46c are formed obliquely toward the end portion 46c side, forming an angle of θ1 in the subscanning direction F and in a width W1 (for example, about 110 μm), in the portion more apart than the distance 1 l exceeding the step difference part 50c due to the protuberance 48c and recess 47c.

In a range of less than the distance l1 and more than the distance l2 corresponding to the step difference 50c, the branching part 49c and the end portion 51 of the end portion 46c side of the individual electrode 24c are formed parallel to the subscanning direction F, and the minimum width W2 of the portion corresponding to the step difference part 50c is formed in W2=2W1/3. In a range of less than distance l2, the branching part 49c and the individual electrode 25c are both width W1, and are formed nearly parallel to the subscanning direction F.

By forming the common electrode 24c and individual electrode 25c as started above, if the recess 47c is formed in the end portion 46c of the head substrate 24c by grinding and cutting the head substrate 22c, the common electrode 24c and individual electrode 25 is free from damage or defect.

On the other hand, as shown in FIG. 12, in the head substrate 22c, for example, located at the upstream side in the conveying direction F from the adjacent head substrate, a recess 47c in a depth of L1 is formed along the principal scanning direction inward of the head substrate 22c, in a range of the downstream side in the conveying direction F from the portion distant by about distance L/2 toward the downstream side in the conveying direction F than the heating resistance element row HL3. Such recesses 47b, 47c are similarly formed in the other head substrates forming the thermal head 21.

Therefore, to join the head substrates 22b, 22c together, the protrusion 48b of the head substrate 22b is set opposite to the recess 47c in the head substrate 22c, and the protrusion 48c of the head substrate 22c to the recess 47b of the head substrate 22b. By joining in this manner, the distance L along the subscanning direction is set in the heating resistance element rows HL2, HL3 of the head substrates 22b, 22c, and the gap g2 of the heating resistance elements 23b, 23c at the remotes position may be set around the gap g1 of the heating resistance element 23.

As the prior art is explained by referring to FIG. 2, if there is a step difference concerning the height from the substrate of the heating resistance element on every heat resistant substrate, white stripe may be formed at the time of thermal printing. To avoid such trouble, the thermal head 21 of the embodiment is composed as shown in FIG. 15. That is, on the head substrates 22a, 22b as shown in FIG. 8, glazed layers 43a, 43b in an arc section with the width W1 (for example, 0.7 to 1.5 mm) and height h1 (for example, 30 to 60 μm) are disposed.

If there is a gap 52 of height difference d1 at the mutually opposing end portions of the adjacent head substrates 22a, 22b, a height difference z1 is also formed in the heating resistance elements 23, 23b at the remotest positions of the heating resistance elements 23 formed on the glazed layers 43a, 43b. At this time, the composition on the head substrates 22a, 22b positioned along the extended line of the arranging direction of the heating resistance element 23a on the head substrate 22a, especially the portion corresponding to the extended line of the glazed layer 43b is set to be lower than the heating resistance element 23a by selecting the length y1. In the illustrated embodiment, cross-sections of the glazed layers 43a and 43b still overlap with each other by the shift length y1. This length y1 is preferably integer multiple of the arranging pitch along the subscanning direction of the heating resistance elements 23 of the thermal head 21, and is selected, for example, at y=0,500 m.

By selecting the configuration of the thermal head 21, especially the glazed layer 43 on every head substrate 22 and the heating resistance element 23 on the adjacent head substrate 22 as mentioned above, if there is a height difference d1 in the head substrates 22a, 22b, the heating resistance element 23a at the lower position contacts with the thermal recording paper, for example, in the thermal printing process, and white stripe is prevented.

In the embodiment, the recess 47 is formed by using a slicer, dicer or the like, after cutting off the long ceramic plate from which the head substrates 22a to 22c are formed and forming the head substrate 22a to 22c. That is, as shown in FIG. 16 and 17, the end portion toward the heating resistance element row HL2 on the head substrate 22b is positioned by a first positioning member 53, and is polished by a polishing wheel 54 in a depth L1 along a length L3 from the end portion of the opposite side, thereby forming the recess 47b. In consequence, this head substrate 22b is rotated a half revolution about the central position as indicated by arrow, and the region of a predetermined length L4 from the end portion of the heating resistance element row HL2 side is polished by the polishing wheel 54 by the depth L1, thereby forming the recess 47b1.

That is, to compose the shape of the head substrates 22a to 22c for forming the thermal head 21 of the embodiment, it is enough to have one type of positioning member 53 and polishing wheel 54, not requiring plural sets of processing device as explained in the prior art, and the construction necessary for manufacturing the thermal head 21 may be downsized and simplified.

At this time, when cutting of the ceramic plate and forming plural head substrates 22, it is known that "wave" or "warp" of about 5 μm in height difference along the principal scanning direction is formed at the end portion 46. Such "wave" produces an undesired spacing of about 5 μm×2=10 μm at the end portions 46b, 46c when joining the end portions 46b, 46c.

Therefore, by cutting off so that the length L1 may more than the "wave" height (for example, 5 μm), spacing of the end potion 46b, 46c due to wave may be prevented, so that the gap g2 of the heating resistance elements 23b, 23c may be set at high precision.

Thus, in the above embodiment, at the junction of joining the head substrates 22a to 22c, white stripe (white out) is prevented at the time of thermal printing, and the printing quality is improved. Besides, faulty contact of the heating resistance elements 23 with the platen roller 39 may be prevented, and undesired variation of resistance or breakage of the heating resistance elements 23 may be prevented, and the reliability may be enhanced. Besides, since the flexible wiring substrate 34 and connected 45 are dispose at one common side of each head substrate 22, so that the construction may be reduced in size. If, moreover, there is a difference in the height d1 in the heating resistance element rows HL of the adjacent head substrates 22, this difference d1 may be easily adjusted in height by using a metal foil spacer or the like to an extent of, for example, 5 to 20 μm. If the step difference achieved at this time is about 5 to 20 μm, white stripe (white out) may be prevented in this embodiment.

FIG. 18 is a sectional view showing a constitutional example of a thermal head 21a in other embodiment of the invention. For example, as shown in FIG. 8, of the three head substrates 22a to 22c, for example, the head substrates 22a, 22b are joined by mutually separating the heating resistance elements 23a, 23b at the spacing of y1, and inclining the head substrates 22a, 22b mutually by an interval θ1 about the axial line of the arranging direction (the direction vertical to the sheet of paper in FIG. 18) of the heating resistance elements 23.

By thus composing, for example, the heating resistance element 23a at the remotest position of the heat substrate 22b side of the heat substrate 22a is positioned as projecting upward from the portion opposite to the heating resistance element 23a of the adjacent head substrate 22b. The same holds true with the heating resistance element 23b at the remotest position of the head substrate 22b. Therefore, it is effective to prevent thermal printing failure due to step difference in the plate thicknesswise direction between the head substrates 22a, 22b by the heating resistance elements 23a, 23b at the remotest positions. In this embodiment, too, the same effects as mentioned in the foregoing embodiments are achieved.

FIG. 19 is a magnified perspective view of a thermal head 21b of a so-called thick film type. The thermal head 21b or this embodiment is formed by disposing glazed layers 43a, 43b on the entire surface of, for example, the head substrates 22a, 22b, and disposing heating resistance element rows HL1, HL2 thereon at a mutual interval of y1 at a height of h1 (for example, 5 μm or more). At this time, as explained in the foregoing embodiments, if there is a step difference between the head substrates 22a, 22b, the height d1 may be adjusted to be about 5 μm by using spacer such as metal foil.

By thus adjusting, the heating resistance element 23a at the remotest position of the head substrates 22a, 22b projects upward from the composition on the adjacent head substrate 22b. That is, in this embodiment, too, the same effects as in the foregoing embodiments may be achieved.

In these embodiments, three head substrates are used to compose the thermal head 21, but the number of substrates is not limited in the invention, and a longer thermal head may be composed by joining more head substrates 22.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalence of the claims are therefore intended to be embraced therein.

What is claimed is:

1. A thermal head defining a principal scanning direction comprising:

a plurality of insulating substrates extending in the principal scanning direction, each of the insulating substrates having an upper surface;

a plurality of angle-shaped heat reserve layers extending in the principal scanning direction, each of the heat reserve layers being disposed on an associated insulating substrate and protruding from the upper surface of the associated insulating substrate; and a plurality of rows of heating resistance elements, each of the rows being linearly disposed on an associated heat reserve layer;

wherein adjacent two of the heat reserve layers have cross-sections overlapping with each other, and adjacent two of the rows of the linear heating resistance elements on the two heat reserve layers are deviated from each other by a distance ranging from 0.2 to 1.5 mm in a subscanning direction perpendicular to the principal scanning direction.

2. A thermal head of claim 1, wherein the heating resistance elements in each of the rows aligned at a predetermined gap, and wherein a gap between two of the heating resistance elements disposed respectively at inner most positions of two adjacent rows of heating resistance elements along the principal scanning direction is substantially the same as the predetermined gap of the heating resistance elements in each of the rows of the heating resistance elements.

3. A thermal head of claim 1, wherein the plurality of insulating substrates define a common side with respect to the plurality of rows of the heating resistance elements, and further comprising a plurality of individual electrodes, each of the individual electrodes being electrically connected to each of the heating resistance elements at the common side of the plurality of insulating substrates.

4. A thermal head of claim 1, wherein each of the angle-shaped heat reserve layers has a height ranging between 30–60 μm from the upper surface of each of the insulating substrates.

5. A thermal head defining a principal scanning direction comprising:

at least a first and a second insulating substrates extending in the principal scanning direction, each of the insulating substrates having an upper surface;

at least a first and a second heat reserve layers extending in the principal scanning direction, the first and the second heat reserve layers being disposed on the first and the second insulating substrates, respectively, each of the first and second heat reserve layers protruding from the upper surface of each of the first and second insulating substrates; and at least a first row and a second row of heating resistance elements linearly disposed at a predetermined pitch, the first and the second rows being disposed on the first and the second heat reserve layers, respectively;

wherein the first and the second heat reserve layers have cross-sections overlapping with each other and are displaced from each other by a predetermined distance in a subscanning direction perpendicular to the principal scanning direction.

6. A thermal head of claim 5, wherein each of the first and the second heat reserve layers has a generally semicircular cross-section.

7. A thermal head of claim 6, wherein each of the first and the second heat reserve layers has a highest point and wherein each of the first and the second rows of heating resistance elements is disposed generally at the highest point of each of the first and the second heat reserve layers, respectively.

8. A thermal head of claim 7, wherein the first and the second rows of the heating resistance elements are displaced from each other by a distance ranging from 0.2 to 1.5 mm.

9. A thermal head of claim 8, wherein the heating resistance elements are arranged to provide a print density in the principal scanning direction of 8 dots/mm.

10. A thermal head of claim 5, wherein each of the first and the second insulating substrates includes a common electrode electrically connected to each of the heating resistance elements, and the first and the second insulating substrates have extreme end portions facing each other and wherein at least a portion of the common electrode located in a closest proximity of the extreme end portions recedes with respect to the extreme end portions so that one of the heating resistance elements located in a closest proximity of the extreme end portions protrudes from said portion of the common electrode in the principal scanning direction.

11. A thermal head of claim 5, wherein at least the first insulating substrate includes a common electrode electrically connected to each of the heating resistance elements and a plurality of individual electrodes, each of the individual electrodes electrically connected to an associated heating resistance element for selectively energizing the associated heating resistance element, wherein the first insulating substrate has an extreme end portion juxtaposed adjacent the second insulating substrate, and wherein at least a portion of the common electrode and at least one of the individual electrodes connected to one of the heating resistance elements located in a closest proximity of the extreme end portion recede with respect to the extreme end portion so that said one of the heating resistance elements protrudes from said portion of the common electrode and said one of the individual electrodes in the principal scanning direction.

12. A thermal head of claim 5, wherein each of the first and the second insulating substrates includes a common electrode electrically connected to each of the heating resistance elements and a plurality of individual electrodes, each of the individual electrodes electrically connected to an associated heating resistance element for selectively energizing the associated heating resistance element, wherein the first and the second insulating substrates have extreme end portions facing each other, and wherein at least a portion of the common electrode and at least one of the individual electrodes connected to one of the heating resistance elements provided on each of the first and the second insulating substrates and located in a closest proximity of the extreme end portions recede with respect to the extreme end portions so that said one of the heating resistance elements protrudes from said portion of the common electrode and said at least one of the individual electrodes in the principal scanning direction.

13. A thermal head of claim 5, wherein the first and second insulating layers have extreme end portions opposing to each other and the first and second heat reserve layers have extreme end faces adjacent the extreme end portions of the first and second insulating substrates wherein at least a part of the extreme end face of the first heat reserve layer overlaps the extreme end face of the second heat reserve layer.

14. A thermal head of claim 5, wherein the first insulating substrate has portions located along an extension line of the second row of heating resistance elements, the portions being lower than the extension line.

15. A thermal head of claim 5, wherein the first heat reserve layer has portions located along an extension line of the second heat reserve layer, the portions of the first heat reserve layer being lower than the extension line.

16. A thermal head defining a principal scanning direction comprising:

a plurality of insulating substrates extending in the principal scanning direction, each of the insulating substrates having an upper surface;

a plurality of angle-shaped heat reserve layers extending in the principal scanning direction, each of the heat reserve layers being disposed on an associated insulating substrate and protruding from the upper surface of the associated insulating substrate;

a plurality of rows of heating resistance elements, each of the rows being linearly disposed on an associated heat reserve layer;

wherein adjacent two of the rows of the linear heating resistance elements are deviated from each other by a distance ranging from 0.2 to 1.5 mm in a subscanning direction perpendicular to the principal scanning direction; and at least one common electrode electrically connected to each of the heating resistance elements in each of the rows of heating resistance elements and a plurality of individual electrodes, each of the individual electrodes being electrically connected to an associated heating resistance element for energizing selected heating resistance elements, wherein adjacent two of the insulating substrates have extreme end portions facing each other and wherein at least a portion of the common electrode and at least one of the individual electrodes located in a closest proximity of the extreme end portion of each of the adjacent two insulating substrates are warped in a convex form toward the heating resistance element.

17. A thermal head defining a principal scanning direction comprising:

at least a first and a second insulating substrates extending in the principal scanning direction, each of the insulating substrates having an upper surface;

at least a first and a second heat reserve layers extending in the principal scanning direction, the first and the second heat reserve layers being disposed on the first and the second insulating substrates, respectively, each of the first and second heat reserve layers protruding from the upper surface of each of the first and second insulating substrates; and at least a first row and a second row of heating resistance elements linearly disposed at a predetermined pitch, the first and the second rows being disposed on the first and the second heat reserve layers, respectively;

wherein the first and the second heat reserve layers are displaced from each other by a predetermined distance in a subscanning direction perpendicular to the principal scanning direction, wherein at least the first insulating substrate includes a common electrode electrically connected to each of the heating resistance elements and a plurality of individual electrodes, each of the individual electrodes electrically connected to an associated heating resistance element for selectively energizing the associated heating resistance element, wherein the first insulating substrate has an extreme end portion juxtaposed adjacent the second insulating substrate, and wherein at least a portion of the common electrode and at least one of the individual electrodes connected to one of the heating resistance elements located in a closest proximity of the extreme end portion recede with respect to the extreme end portion so that said one of the heating resistance elements protrudes from said portion of the common electrode and said one of the individual electrodes in the principal scanning direction, and wherein the extreme end portion of the first insulating substrate has a step-like recess having a predetermined depth in the principal scanning direction and being located about half of the predetermined displacement distance from the first row of the heating resistance elements and between the first and the second rows of heating resistance elements.

18. A thermal head defining a principal scanning direction comprising:

at least a first and a second insulating substrates extending in the principal scanning direction, each of the insulating substrates having an upper surface;

at least a first and a second heat reserve layers extending in the principal scanning direction, the first and the second heat reserve layers being disposed on the first and the second insulating substrates, respectively,each of the first and second heat reserve layers protruding from the upper surface of each of the first and second insulating substrates; and at least a first row and a second row of heating resistance elements linearly disposed at a predetermined pitch, the first and the second rows being disposed on the first and the second heat reserve layers, respectively;

wherein the first and the second heat reserve layers are displaced from each other by a predetermined distance in a subscanning direction perpendicular to the principal scanning direction, wherein each of the first and the second insulating substrates includes a common electrode electrically connected to each of the heating resistance elements and a plurality of individual electrodes, each of the individual electrodes electrically connected to an associated heating resistance element for selectively energizing the associated heating resistance element, wherein the first and the second insulating substrates have extreme end portions facing each other, and wherein at least a portion of the common electrode and at least one of the individual electrodes connected to one of the heating resistance elements provided on each of the first and the second insulating substrates and located in a closest proximity of the e extreme end portions recede with respect to the extreme end portions so that said one of the heating resistance elements protrudes from said portion of the common electrode and said at least one of the individual electrodes in the principal scanning direction, and wherein the extreme end portions of the first and the second insulating substrates each have a step-like shape defining a protrusion and a recess complementary to the step-like shape of the other wherein the end portion recess of one insulating substrate is shaped to receive the end portion protrusion of the other insulating substrate, each of the recesses having a predetermined depth in the principal scanning direction and being located centrally between the first and the second rows of heating resistance elements.

19. A thermal head defining a principal scanning direction comprising:

at least a first and a second insulating substrates extending in the principal scanning direction, each of the insulating substrates having an upper surface;

at least a first and a second heat reserve layers extending in the principal scanning direction, the first and the second heat reserve layers being disposed on the first and the second insulating substrates, respectively, each of the first and second heat reserve layers having a generally semi-circular cross-section and protruding from the upper surface of each of the first and second insulating substrates;

at least a first row and a second row of heating resistance elements linearly disposed at a predetermined pitch, each of the first and the second rows being disposed on a top portion of the semi-circular cross-section of each of the first and the second heat reserve layers, respectively;

wherein the first and the second rows of heating resistance elements are displaced from each other by a predetermined distance in a subscanning direction perpendicular to the principal scanning direction, and the cross-sections of the first and the second heat reserve layers overlap with each other;

a common electrode provided on each of the first and the second insulating substrates, the common electrode being electrically connected to each of the heating resistance elements disposed on each of the first and the second heat reserve layers;

a plurality of individual electrodes provided on each of the first and the second insulating layers, each of the individual electrodes being electrically connected to an associated heating resistance element for selectively energizing the associated heating resistance element;

wherein the first and the second insulating substrates have extreme end portions facing each other, and wherein at least a portion of the common electrode and at least one of the individual electrodes connected to one of the heating resistance elements provided on each of the first and the second insulating substrates and located in a closest proximity of the extreme end portions recede with respect to the extreme end portions so that said one of the heating resistance elements protrudes from said portion of the common electrode and said at least one of the individual electrodes in the principal scanning direction; and a platen disposed opposing to the first and the second rows of heating resistance elements, said platen having an area substantially covering both the first and the second rows of the heating resistance elements.

20. A thermal head of claim 19, wherein the first and the second rows of the heating resistance elements are displaced from each other by a distance ranging from 0.2 to 1.5 mm.

21. A thermal head of claim 20, wherein the heating resistance elements are arranged to provide a print density in the principal scanning direction of 8 dots/mm.

22. A thermal head of claim 21, wherein the platen is about 38 mm in diameter and is pushed against the first and the second heat reserve layers at a pressing force of 0.15 Kg/cm.

23. A thermal head of claim 19, wherein the first insulating substrate is rotated about an axis along the principal scanning line by a predetermined angle with respect to the second insulating substrate.

24. A thermal head defining a principal scanning direction comprising:

at least a first and a second insulating substrates extending in the principal scanning direction, each of the insulating substrates having an upper surface;

at least a first and a second heat reserve layers extending in the principal scanning direction, the first and the second heat reserve layers being disposed on the first and the second insulating substrates, respectively, each of the first and second heat reserve layers protruding from the upper surface of each of the first and second insulating substrates; and at least a first row and a second row of heating resistance elements linearly disposed at a predetermined pitch, the first and the second rows being disposed on the first and the second heat reserve layers, respectively;

wherein the first and the second heat reserve layers are displaced from each other by a predetermined distance in a subscanning direction perpendicular to the principal scanning direction, and wherein each of the first and the second insulating substrates includes a common electrode electrically connected to each of the heating resistance elements, and the first and the second insulating substrates have extreme end portions facing each other and wherein the common electrode of the first insulating substrate has a recessed portion receded with respect to the extreme end portion thereof, and one of the heating resistance elements on the second insulating substrate located in a closest proximity of the extreme end portion thereof opposes the recessed portion of the common electrode of the first insulating substrate.

25. A thermal head of claim 24, wherein each of the first and the second insulating substrates includes a plurality of individual electrodes, each of the individual electrodes being electrically connected to an associated heating resistance element for selectively energizing the associated heating resistance element, wherein at least one of the individual electrodes connected to one of the heating resistance elements provided on the first insulating substrate in a closest proximity of the extreme end portion thereof has a recessed portion receded with respect to the extreme end portion thereof, and one of the heating resistance elements on the second insulating substrate located in a closest proximity of the extreme end portion thereof opposes the recessed portion of said at least one of the individual electrodes of the first insulating substrate.

* * * * *